US007028491B2

(12) United States Patent
Horton

(10) Patent No.: US 7,028,491 B2
(45) Date of Patent: Apr. 18, 2006

(54) METHOD AND APPARATUS FOR REDUCING INRUSH CURRENT IN A MULTI-STAGE COMPRESSOR

(75) Inventor: W. Travis Horton, Manchester, MI (US)

(73) Assignee: Tecumseh Products Company, Tecumseh, MI (US)

( * ) Notice: Subject to any disclaimer, the term of this patent is extended or adjusted under 35 U.S.C. 154(b) by 66 days.

(21) Appl. No.: 10/812,213

(22) Filed: Mar. 29, 2004

(65) Prior Publication Data

US 2005/0210895 A1 Sep. 29, 2005

(51) Int. Cl.

| | |
|---|---|
| ***G05D 23/32*** | (2006.01) |
| ***F25B 7/00*** | (2006.01) |
| ***F04B 41/06*** | (2006.01) |
| ***F04B 49/00*** | (2006.01) |

(52) U.S. Cl. ..... 62/158; 62/175; 62/510; 417/2; 417/12; 417/245; 417/290

(58) Field of Classification Search ..... 62/157, 62/158, 175, 231, 510; 417/2, 12, 16, 17, 417/245, 290

See application file for complete search history.

(56) References Cited

U.S. PATENT DOCUMENTS

| | | | | |
|---|---|---|---|---|
| 2,921,732 A | | 1/1960 | De Vin | 230/2 |
| 3,710,214 A | | 1/1973 | Anderson | 318/102 |
| 4,033,738 A | * | 7/1977 | Merola et al. | 62/158 |
| 4,100,466 A | | 7/1978 | Schroeder | 318/102 |
| 4,152,902 A | | 5/1979 | Lush | 62/157 |
| 4,277,955 A | * | 7/1981 | Parker | 62/510 |
| 4,535,602 A | | 8/1985 | Alsenz et al. | 62/175 |
| 4,612,776 A | | 9/1986 | Alsenz | 62/175 |
| 4,825,662 A | | 5/1989 | Alsenz | 62/117 |
| 4,831,832 A | | 5/1989 | Alsenz | 62/117 |
| 4,887,941 A | | 12/1989 | Crinquette et al. | 417/2 |
| 4,915,475 A | | 4/1990 | Deimel | 350/162.2 |
| 5,211,031 A | | 5/1993 | Murayama et al. | 62/498 |
| 5,231,846 A | | 8/1993 | Goshaw et al. | 62/175 |
| 5,265,434 A | | 11/1993 | Alsenz | 62/117 |
| 5,518,373 A | | 5/1996 | Takagi et al. | 417/45 |
| 5,572,878 A | | 11/1996 | Kapoor | 62/175 |
| 6,056,510 A | | 5/2000 | Miura et al. | 417/2 |
| 6,119,469 A | | 9/2000 | Elwood | 62/126 |
| 6,142,740 A | | 11/2000 | Connell | 417/2 |
| 6,186,743 B1 | | 2/2001 | Romer | 417/3 |
| 6,216,479 B1 | | 4/2001 | Elwood | 62/230 |
| 6,233,954 B1 | | 5/2001 | Mehaffey et al. | 62/175 |
| 6,419,454 B1 | | 7/2002 | Christiansen | 417/4 |
| 2002/0119050 A1 | | 8/2002 | Nakamura et al. | 417/2 |

* cited by examiner

*Primary Examiner*—Marc Norman
(74) *Attorney, Agent, or Firm*—Baker & Daniels

(57) ABSTRACT

A compressor assembly having a first compression mechanism operatively coupled to a first motor and a second compression mechanism operatively coupled to a second motor. The first compression mechanism compresses the vapor from a low pressure to an intermediate pressure and the second compression mechanism compresses the vapor from the intermediate pressure to a discharge pressure. An electrical circuit supplies electrical current to the first and second motors during operation of the compressor assembly. The electrical circuit includes means for, during start-up of the compressor assembly, initiating the supply of electrical current to the first motor at a first time and initiating the supply of electrical current to the second motor at a second time wherein the first time precedes the second time by a time lapse.

23 Claims, 4 Drawing Sheets

METHOD AND APPARATUS FOR REDUCING INRUSH CURRENT IN A MULTI-STAGE COMPRESSOR

BACKGROUND OF THE INVENTION

1. Field of the Invention

The present invention relates to a multi-stage compressor, and, more particularly, to the controlled start-up of the compressor stages.

2. Description of the Related Art

Known uses of conventional multi-stage compressors include heat pump, air conditioning, and refrigeration system applications. Often times such compressors include first and second stage compression mechanisms that are mounted at opposite ends of a drive motor. The drive motor is drivingly linked to each of the first and second stage compression mechanisms by a drive shaft. Typically, the drive shaft engages the first and second stage compression mechanisms so that they are out of phase from one another, i.e., at different points in the compression cycle. Multi-stage compressors wherein each of the compression mechanisms are arranged in series are well suited for applications where a high pressure difference in the working fluid is required, such as when using carbon dioxide. For the compressor to provide such relatively large pressure increases, a relatively large motor is also typically required.

In operation of a two-staged compressor, electrical power is supplied to the motor which in turn simultaneously drives the first and second stage compression mechanisms. Refrigerant is compressed in the first stage from a suction pressure to an intermediate pressure. The intermediate pressure refrigerant is then supplied to the second stage compression mechanism and is compressed from the intermediate pressure to a higher, discharge pressure. The discharge pressure refrigerant is then supplied to the associated system or application, e.g., a refrigeration system.

During start-up of a multi-stage compressor driven by a single motor, the initial start-up current, i.e., the inrush current, of the motor may be several times greater than the operating or steady-state current of the motor. This initial spike of current can be damaging to the motor or power supply and thereby reduce the life of the equipment.

SUMMARY OF THE INVENTION

The present invention provides a multi-stage compressor having a plurality of motors for operating the different stages of the compressor. During start-up of the compressor, the motors are started sequentially to minimize the inrush current spike. Each compressor stage includes a compression mechanism and a motor drivingly linked by a drive shaft. In the multi-staged compressor, the first stage compressor operates to compress suction pressure refrigerant to an intermediate pressure. The intermediate pressure refrigerant is then supplied to the second stage compressor where it is compressed to a higher, discharge pressure. The motors of the first and second stage compressors are each smaller than a single motor which would drive the compression mechanisms of both stages. The motors and compression mechanisms may be located in a single housing, or in individual housings. The motors are started sequentially with the second motor being started after a preset time delay to minimize the instantaneous inrush of current to the multi-stage compressor.

The invention comprises, in one form thereof, a compressor assembly for compressing a vapor. The compressor assembly has a first compression mechanism and a first motor operably coupled to the first compression mechanism, the first compression mechanism compressing the vapor from a low pressure to an intermediate pressure. The compressor assembly also has a second compression mechanism and a second motor operably coupled to the second compression mechanism, the second compression mechanism compressing the vapor from the intermediate pressure to a discharge pressure. An electrical circuit supplies electrical current to the first and second motors during operation of the compressor assembly and includes means for, during start-up of the compressor assembly, initiating the supply of electrical current to the first motor at a first time and initiating the supply of electrical current to the second motor at a second time wherein the first time precedes the second time by a time lapse.

The first compression mechanism, the first motor, the second compression mechanism, and the second motor can be housed in a single housing. The initiating means can include a time delay relay operably disposed in the electrical circuit between a power source and the second motor. The duration of the time lapse can be provided with a predetermined value that allows the first motor to reach a stable operating state prior to initiating the supply of current to the second motor.

The invention comprises, in another form thereof, a compressor assembly for compressing a vapor, the compressor assembly includes a first compression mechanism and a first motor operably coupled to the first compression mechanism, the first compression mechanism compressing the vapor from a low pressure to an intermediate pressure. The first compression mechanism and the first motor are mounted in a first housing. A second compression mechanism and a second motor are operably coupled to the second compression mechanism, the second compression mechanism compressing the vapor from the intermediate pressure to a discharge pressure, the second compression mechanism and the second motor mounted in a second housing. An electrical circuit supplies electrical current to the first and second motors during operation of the compressor assembly and includes means for, during start-up of the compressor assembly, initiating the supply of electrical current to the first motor at a first time and initiating the supply of electrical current to the second motor at a second time wherein the first time precedes the second time by a time lapse.

The invention comprises, in yet another form thereof, a compressor assembly for compressing a vapor, the compressor assembly including a first compression mechanism and a first motor operably coupled to the first compression mechanism, the first compression mechanism compressing the vapor from a low pressure to an intermediate pressure. The first compression mechanism and the first motor are mounted in a housing. A second compression mechanism and a second motor are operably coupled to the second compression mechanism, the second compression mechanism compressing the vapor from the intermediate pressure to a discharge pressure. The second compression mechanism and the second motor are mounted in the housing. An electrical circuit supplies electrical current to the first and second motors during operation of the compressor assembly and includes means for, during start-up of the compressor assembly, initiating the supply of electrical current to the first motor at a first time and initiating the supply of electrical current to the second motor at a second time wherein the first time precedes the second time by a time lapse.

The invention comprises, in a further form thereof, a method of initiating operation of a multi-stage compressor assembly, the method including providing a first motor for driving a first compression mechanism. The first compression mechanism compresses a vapor from a first, low pressure to a second, intermediate pressure during operation of the first compression mechanism. A second motor is provided for driving a second compression mechanism. The second compression mechanism compresses the vapor from the second, intermediate pressure to a third, discharge pressure during operation of the second compression mechanism. Electrical current is supplied to the first motor to initiate operation of the first motor at a first time. Electrical current is supplied to the second motor to initiate operation of the second motor at a second time wherein the first time precedes the second time by a time lapse.

An advantage of the present invention is that each stage of the multi-stage compressor pumps against only a portion of the overall pressure difference between the suction and discharge pressures, thereby allowing the motors for each compressor stage to be smaller.

Another advantage is that, since two separate motors are used, the start-up of each motor can be timed in sequence to minimize the inrush current.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
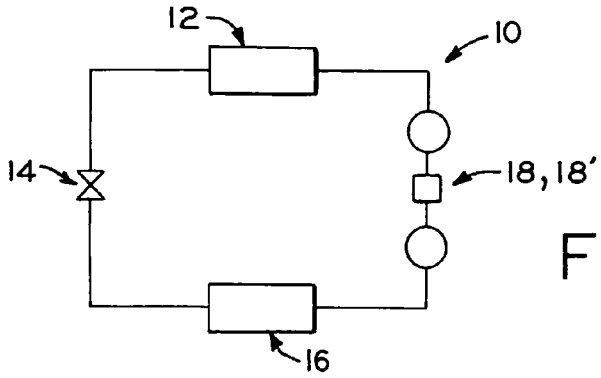
FIG. 1 is a schematic view of a refrigeration system in accordance with the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring to FIG. 1, refrigeration system 10 includes condenser 12, expansion valve 14, evaporator 16, and a compressor assembly 18. Compressor assembly 18 can be a hermetic compressor having at least two stages. The compressor stages may be any suitable type of compressor mechanism including rotary, scroll and reciprocating piston compressors. Illustrated refrigeration system 10 can use carbon dioxide as the working fluid, i.e., as the refrigerant. However, any suitable type of working fluid may be used.

Figure 2:
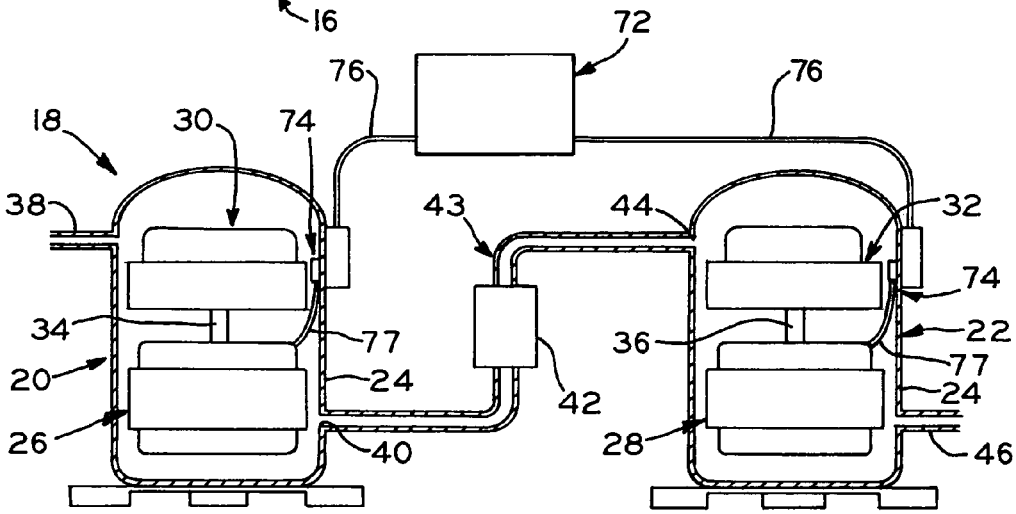
FIG. 2 is a schematic view of a first embodiment of a multi-stage compressor of the refrigeration system of FIG. 1.

Referring to FIG. 2, a first embodiment of compressor 18 is illustrated. Compressor 18 is a two-stage compressor including first stage compressor 20 and second stage compressor 22. Each compressor stage 20 and 22 includes a respective housing 24 in which motors 26 and 28 are mounted. Housings 24 can be hermetic, with the exception of each having an inlet and an outlet, as discussed below. First and second stage compression mechanisms 30 and 32 are each mounted adjacent to one end of motors 26 and 28, respectively, and are drivingly connected thereto by respective drive shafts 34 and 36.

First-stage compressor 20 has a suction inlet 38 through which refrigerant gas, i.e., vapor, at suction pressure enters compressor 20. The suction pressure gas is compressed in compression mechanism 30 to an intermediate pressure. The intermediate pressure gas is exhausted from first-stage compressor 20 through intermediate pressure outlet 40. The intermediate pressure gas may enter an intercooler 42 that can be located along a passage 43 extending between first stage compressor 20 and second stage compressor 22. The temperature of the intermediate pressure gas can be reduced in intercooler 42. The cooled, intermediate pressure gas enters second stage compressor 22 through intermediate pressure inlet 44 and is compressed to a higher, discharge pressure in compression mechanism 32. The discharge pressure gas can then be exhausted to condenser 12 through discharge outlet 46.

First and second stage compressors 20, 22 can be independently operated by power supply and controller 72 which can be electrically connected by wires 76 to terminal assemblies 74 respectively associated with each compressor stage. Each terminal assembly 74 can be electrically connected to a respective one of motors 26, 28 by wires 77 such that electrical power can be supplied to motors 26, 28 to operate compressors 20, 22. By providing each compressor mechanism with a respective motor, the size of the motors can be smaller than a single motor that drives both compression mechanisms of a two-stage compressor. In general, the size of each of motors 26, 28 can be approximately half of the size of a single motor that drives both compression mechanisms of a two-stage compressor. For example, a single 16 horsepower motor can be used to drive both compression mechanisms of a two-stage compressor; and two 8 horsepower motors can be used to drive respective compression mechanisms of a two-stage compressor.

Power supply and controller 72 can be programmed so that electrical power is supplied to the motors 26 and 28 to start the motors sequentially. By starting the motors sequentially, the instantaneous inrush of current to the multi-stage compressor is minimized, which in turn extends the life of motors 26, 28 and power supply and controller 72, for example. A time lapse can have a duration between operation of the first and second stage motors 26, 28 of approximately between 2 and 5 seconds. The time lapse can be provided with a predetermined value that is selected to allow first motor 26 to reach a stable operating state prior to initiating the supply of current to second motor 28.

Motors 26, 28 can be single speed motors wherein first motor 26 reaches a substantially constant rotational speed before current is supplied to second motor 28. Upon reaching a stable operating state, second motor 28 can run at the same substantially constant rotational speed at which first motor 26 runs. That is, during operation of the compressor assembly, motors 26, 28 can be operated at a single speed.

Figure 3:
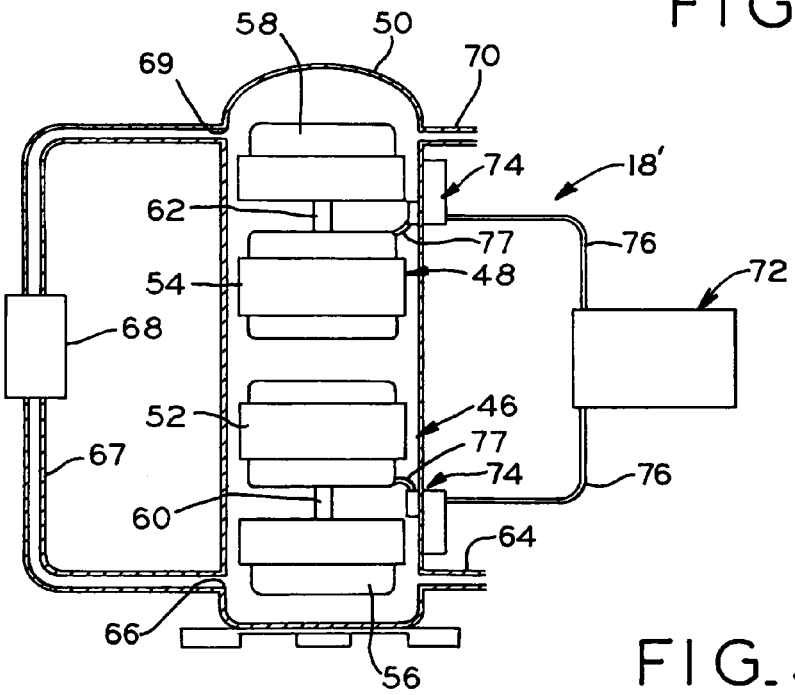
FIG. 3 is a schematic view of a second embodiment of a multi-stage compressor of the refrigeration system of FIG. 1.

Referring now to FIG. 3, another embodiment of a compressor suitable for use in refrigeration system 10 of FIG. 1 is shown. Compressor assembly 18' includes first and second stage compressors 46 and 48 which are housed in a single housing 50. Housing 50 can be hermetic, with the exception of having inlets and outlets as discussed below. Compressor assembly 18' is illustrated as being in a substantially vertical orientation. However, it is also possible for compressor assembly 18' to be placed in a substantially horizontal orientation. First and second stage compressors 46 and 48 include motors 52 and 54, respectively, which are drivingly linked to respective compression mechanisms 56 and 58 by respective drive shafts 60 and 62.

In operation, suction pressure gas, i.e., vapor, is drawn into first stage compressor 46 through inlet 64 and is compressed by first stage compressor 46 to an intermediate pressure. The intermediate pressure gas exits housing 50 through intermediate pressure outlet 66. The intermediate pressure gas can then enter an intercooler 68 that may be located along a passage 67 extending between first stage compressor 46 and second stage compressor 48. Intercooler 68 can reduce the temperature of the intermediate pressure gas before the gas enters second stage compressor 48 through intermediate pressure inlet 69. The cooled, intermediate pressure gas is compressed to a higher, discharge pressure in second stage compressor 48 and can be supplied to condenser 12 through outlet 70.

First and second stage compressors 46, 48 can be independently operated by power supply and controller 72 which can be electrically connected by wires 76 to terminal assemblies 74 respectively associated with each compressor stage. Each terminal assembly 74 can be electrically connected to a respective one of motors 52, 54 by wires 77 such that electrical power can be supplied to motors 52, 54 to operate first and second stage compressors 46, 48. By providing each compressor mechanism with a respective motor, the size of the motors can be smaller than a single motor that drives both compression mechanisms of a two-stage compressor. In general, the size of each of motors 52, 54 can be approximately half of the size of a single motor that drives both compression mechanisms of a two-stage compressor. For example, a single 16 horsepower motor can be used to drive both compression mechanisms of a two-stage compressor; and two 8 horsepower motors can be used to drive respective compression mechanisms of a two-stage compressor.

Power supply and controller 72 can be programmed so that electrical power is supplied to the motors 52 and 54 to start the motors sequentially. By starting the motors sequentially, i.e., non-simultaneously or in a time-staggered fashion, the instantaneous inrush of current to the multi-stage compressor is minimized, which in turn extends the life of motors 52, 54 and power supply and controller 72, for example. A time lapse duration between operation of the first and second stage motors 52, 54 can be approximately between 2 and 5 seconds. The time lapse can be provided with a predetermined value that is selected to allow first motor 52 to reach a stable operating state prior to initiating the supply of current to second motor 54.

Motors 52, 54 can be single speed motors wherein first motor 52 reaches a substantially constant rotational speed before current is supplied to second motor 54. Upon reaching a stable operating state, second motor 54 can run at the same substantially constant rotational speed at which first motor 52 runs. That is, during operation of the compressor assembly, motors 52, 54 can be operated at a single speed.

Figure 4:
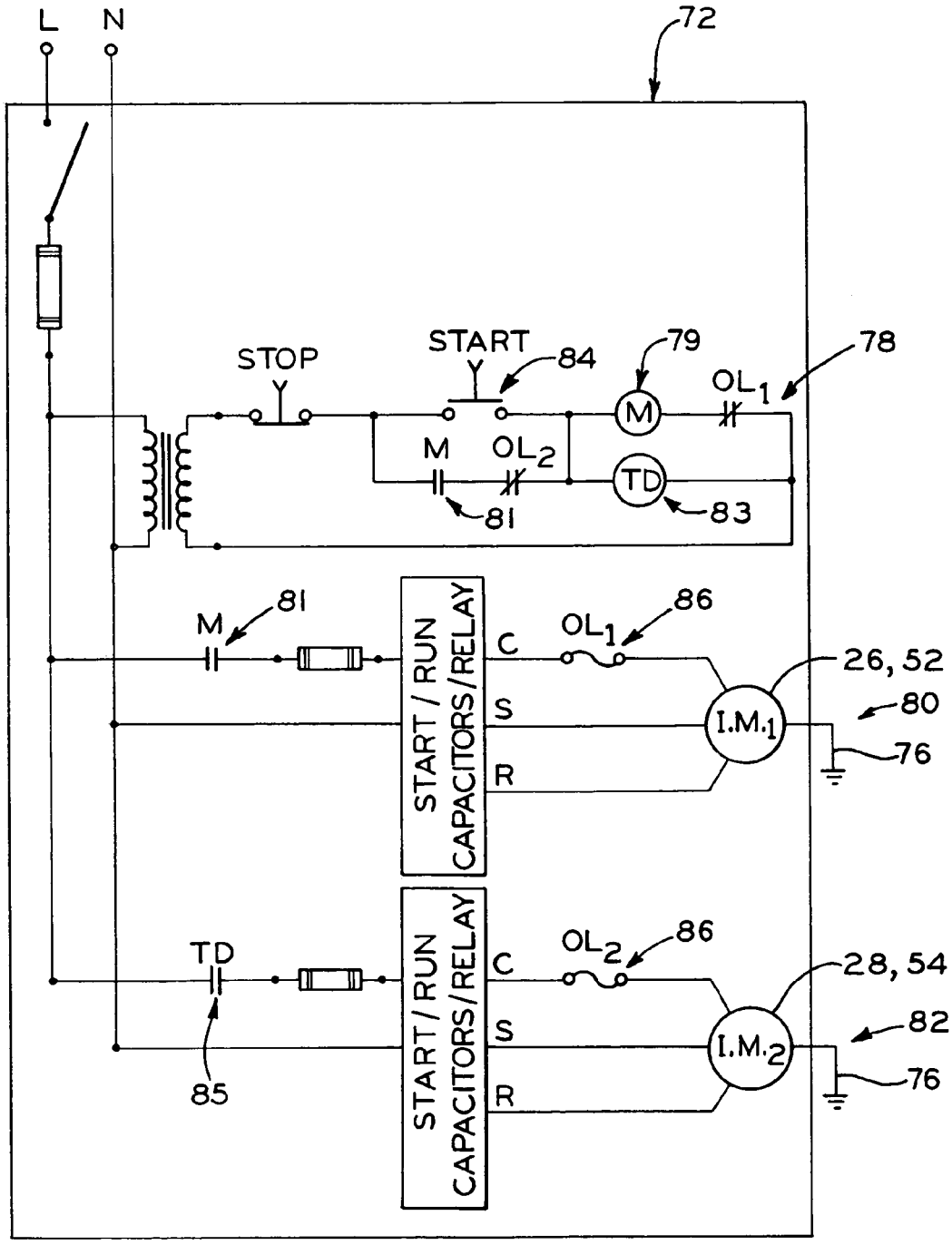
FIG. 4 is a schematic view of a first embodiment of the power supply and controller of the multi-stage compressors of FIGS. 2 and 3.
Figure 5:
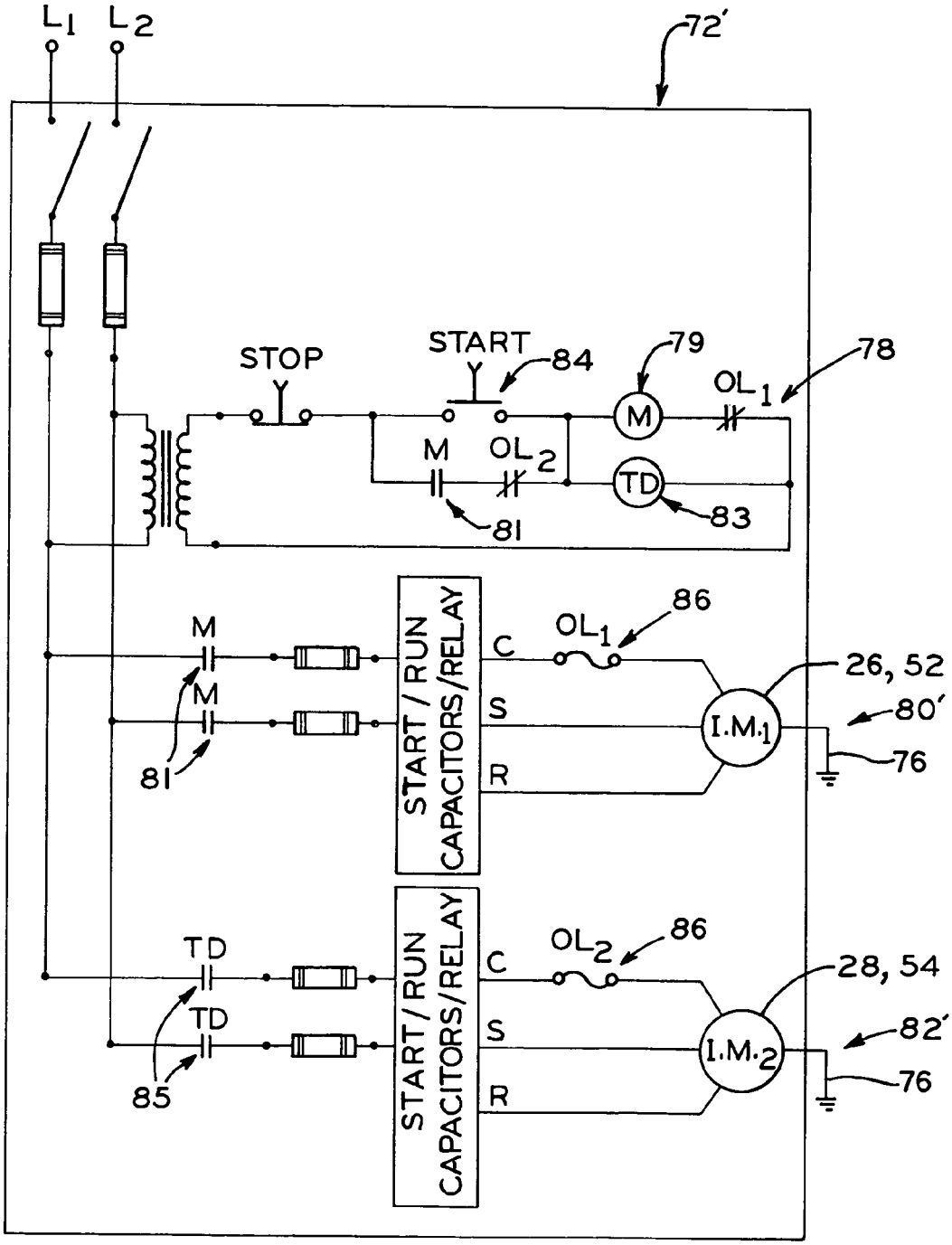
FIG. 5 is a schematic view of a second embodiment of the power supply and controller of the multi-stage compressors of FIGS. 2 and 3.
Figure 6:
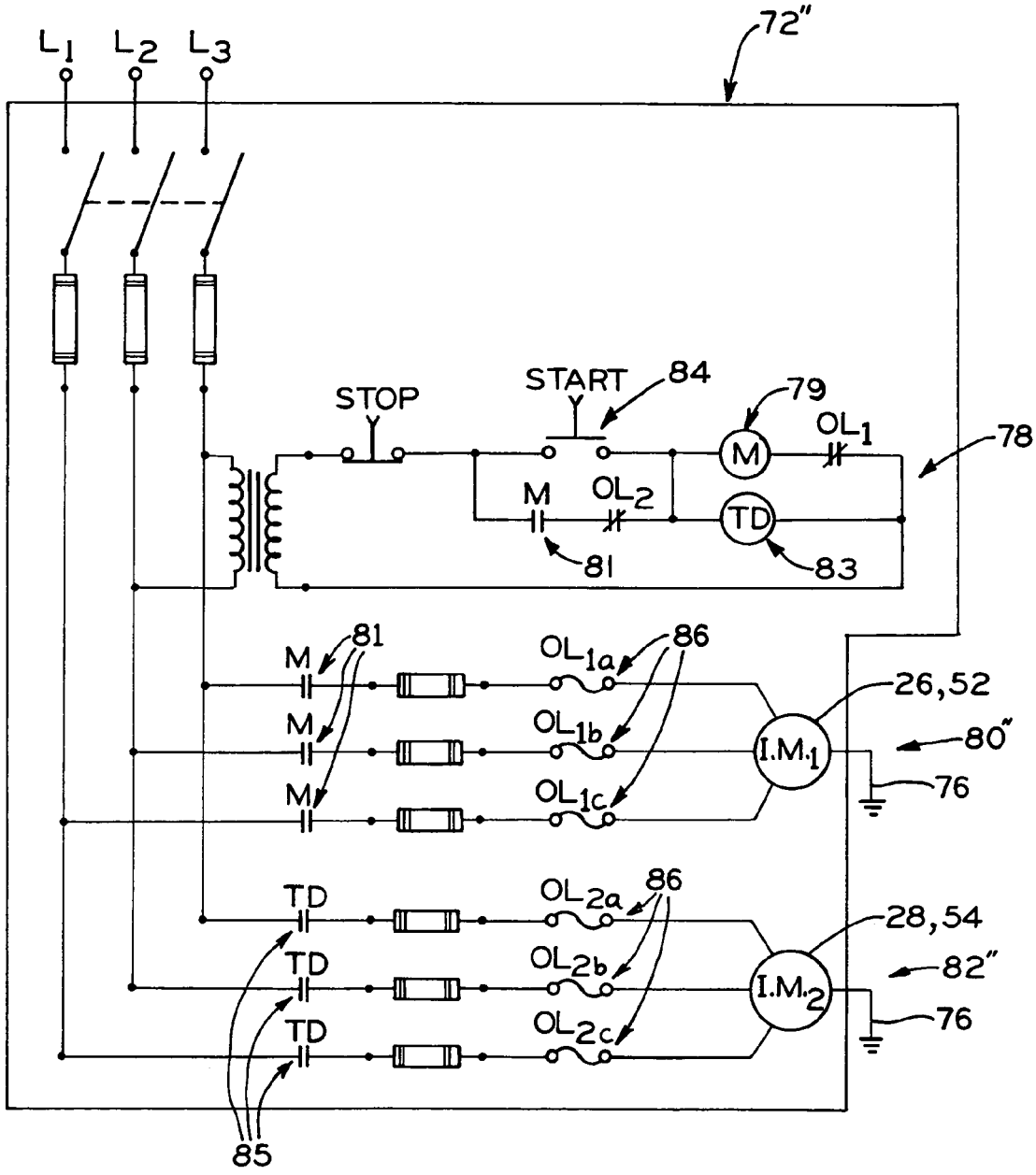
FIG. 6 is a schematic view of a third embodiment of the power supply and controller of the multi-stage compressors of FIGS. 2 and 3.

Power supply and controller 72 can be wired having any of several different configurations illustrated in FIGS. 4, 5, and 6, for example. Referring to FIG. 4, power supply and controller 72 may include a single-phase power supply having a hot line and a neutral line which connect to a power source (not shown). In this wiring configuration, start/stop circuit 78 is operated to supply power to first stage compressor motor circuit 80 and second stage compressor motor circuit 82. When start switch 84 is actuated, start-stop circuit 78 is energized with electrical current flowing through the entire circuit. The electrical current passes through and closes "M" relay 79, which in turn causes "M" contactors 81 to close and energize first stage compressor motor circuit 80. Once first stage compressor motor circuit 80 is energized, a motor, such as motor 26 or motor 52, is supplied with electrical power through wire 76, terminal assembly 74, and wire 77.

When start/stop circuit 78 is energized and electrical current flows through "M" relay 79, electrical current simultaneously flows through a current-initiating device in the form of a "TD" relay or "time delay" relay 83. The time delay relay can be any conventional, commercially available delay-on-start relay. Once energized, time delay relay 83 closes after the predetermined length of time has lapsed and causes "TD" contactors 85 to close. With TD contactors 85 closed, electrical current is supplied to second stage compressor motor circuit 82, and thus to another motor, such as motor 28 or motor 54, via wire 76, terminal assembly 74, and wire 77. TD relay 83 is disposed between the power source and the second motor, 28 or 54. The time delay is preset so that the inrush current can be controlled, and thus minimized.

Additionally, each compressor motor circuit 80 and 82 is provided with overload protection 86 which is tied to the contacts of start/stop circuit 78 so that if, for example, one motor drops out, the second motor also drops out. A motor may drop out if the compressor is faulty and locks up, for example. By preventing operation of just one stage of compressor 18 or compressor 18', excessive damage to the compressor may be avoided.

Referring to FIGS. 5 and 6, alternative wiring configurations are illustrated. As with the configuration discussed above, the configurations of FIGS. 5 and 6 include stop/start circuit 78, first stage compressor motor circuit 80, and second stage compressor motor circuit 82. Referring to the embodiment of power supply and controller 72' shown in FIG. 5, this is a three-phase system which operates single-phase motors 26, 28 or single-phase motors 52, 54. The system includes two hot lines electrically connected to the power source, both of which supply current to drive the compressor motors. The embodiment of power supply and controller 72" shown in FIG. 6 includes three hot lines, electrically connected to a power source, defining a three-phase system capable of supplying electrical power to three-phase motors.

A time delay relay 83 has been disclosed herein as initiating current to the first motor and the second motor at different points in time. However, it is to be understood that any device capable of initiating current to the motors at two separate points in time can be used in place of relay 83 within the scope of the present invention. For example, one or more integrated circuits can be used to open or close switching devices, such as transistors, at two points in time that are approximately between 2 seconds and 5 seconds apart to thereby initiate current to the motors at two separate points in time.

It has also been disclosed herein that the time lapse can be provided with a predetermined duration of approximately between 2 seconds and 5 seconds. However, it is also possible for the duration of the time lapse to not be predetermined. For example, it is possible within the scope of the invention for the initiation of current to the second motor to be triggered by some event, such as the current level in the first motor dropping below a predetermined level, or the first compression mechanism reaching a predetermined pressure. Moreover, regardless of whether the time lapse is predetermined, it is possible in some embodiments of the present invention for the duration of the time lapse to be outside the range of 2 to 5 seconds.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly for compressing a vapor, said compressor assembly comprising:

a suction inlet;

a discharge outlet;

a first compression mechanism and a first motor operably coupled to said first compression mechanism, said first compression mechanism compressing the vapor from a low pressure to an intermediate pressure, said first compression mechanism in fluid communication with said suction inlet;

a second compression mechanism and a second motor operably coupled to said second compression mechanism, said second compression mechanism compressing the vapor from the intermediate pressure to a discharge pressure, said second compression mechanism in fluid communication with said discharge outlet, said second compression mechanism downstream of said first compression mechanism and in fluid communication therewith; and an electrical circuit supplying electrical current to said first and second motors during operation of said compressor assembly, said electrical circuit including a current-initiating device configured to, during start-up of said compressor assembly, initiate the supply of electrical current to said first motor at a first time and initiate the supply of electrical current to said second motor at a second time wherein said first time precedes said second time by a time lapse.

2. The compressor assembly of claim 1 wherein said first compression mechanism and said first motor are housed in a first housing and said second compression mechanism and said second motor are housed in a second housing.

3. The compressor assembly of claim 1 wherein said first compression mechanism and said first motor and said second compression mechanism and said second motor are housed in a single housing.

4. The compressor assembly of claim 1 wherein said current-initiating device includes a time delay relay operably disposed in the electrical circuit between a power source and said second motor.

5. The compressor assembly of claim 1 wherein said time lapse is provided with a predetermined value that is selected to allow said first motor to reach a stable operating state prior to initiating the supply of current to said second motor.

6. The compressor assembly of claim 1 wherein said time lapse is approximately between 2 seconds and 5 seconds.

7. The compressor assembly of claim 1 wherein said first motor and said second motor comprise single speed motors.

8. A compressor assembly for compressing a vapor, said compressor assembly comprising:

a suction inlet;

a first housing;

a first compression mechanism and a first motor operably coupled to said first compression mechanism, said first compression mechanism compressing the vapor from a low pressure to an intermediate pressure, said first compression mechanism and said first motor mounted in said first housing, said first compression mechanism in fluid communication with said suction inlet;

a discharge outlet;

a second housing;

a second compression mechanism and a second motor operably coupled to said second compression mechanism, said second compression mechanism compressing the vapor from the intermediate pressure to a discharge pressure, said second compression mechanism and said second motor mounted in said second housing, said second compression mechanism in fluid communication with said discharge outlet, said second compression mechanism downstream of said first compression mechanism and in fluid communication therewith; and an electrical circuit supplying electrical current to said first and second motors during operation of said compressor assembly, said electrical circuit including means for, during start-up of said compressor assembly, initiating the supply of electrical current to said first motor at a first time and initiating the supply of electrical current to said second motor at a second time wherein said first time precedes said second time by a time lapse.

9. The compressor assembly of claim 8 wherein said means comprise a time delay relay disposed in the electrical circuit between a power source and said second motor.

10. The compressor assembly of claim 8 wherein said time lapse is provided with a predetermined value that is selected to allow said first motor to reach a stable operating state prior to initiating the supply of current to said second motor.

11. The compressor assembly of claim 8 wherein said time lapse is approximately between 2 seconds and 5 seconds.

12. The compressor assembly of claim 8 wherein said first motor and said second motor comprise single speed motors.

13. A compressor assembly for compressing a vapor, said compressor assembly comprising:

a housing including a suction inlet and a discharge outlet;

a first compression mechanism and a first motor operably coupled to said first compression mechanism, said first compression mechanism compressing the vapor from a low pressure to an intermediate pressure, said first compression mechanism and said first motor mounted in said housing, said first compression mechanism in fluid communication with said suction inlet;

a second compression mechanism and a second motor operably coupled to said second compression mechanism, said second compression mechanism compressing the vapor from the intermediate pressure to a discharge pressure, said second compression mechanism and said second motor mounted in said housing, said second compression mechanism in fluid communication with said discharge outlet, said second compression mechanism downstream of said first compression mechanism and in fluid communication therewith; and an electrical circuit supplying electrical current to said first and second motors during operation of said compressor assembly, said electrical circuit including means for, during start-up of said compressor assembly, initiating the supply of electrical current to said first motor at a first time and initiating the supply of electrical current to said second motor at a second time wherein said first time precedes said second time by a time lapse.

14. The compressor assembly of claim 13 wherein said means comprise a time delay relay disposed in the electrical circuit between a power source and said second motor.

15. The compressor assembly of claim 13 wherein said time lapse is provided with a predetermined value that is selected to allow said first motor to reach a stable operating state prior to initiating the supply of current to said second motor.

16. The compressor assembly of claim 13 wherein said time lapse is approximately between 2 seconds and 5 seconds.

17. The compressor assembly of claim 13 wherein said first motor and said second motor comprise single speed motors.

18. A method of initiating operation of a multi-stage compressor assembly having a suction inlet and a discharge outlet, said method comprising:

providing a first motor for driving a first compression mechanism, said first compression mechanism compressing a vapor from a first, low pressure to a second, intermediate pressure during operation of said first compression mechanism said, first compression mechanism in fluid communication with the suction inlet;

providing a second motor for driving a second compression mechanism, said second compression mechanism compressing the vapor from the second, intermediate pressure to a third, discharge pressure during operation of said second compression mechanism, said second compression mechanism in fluid communication with the discharge outlet, said second compression mechanism downstream of said first compression mechanism and in fluid communication therewith;

supplying electrical current to said first motor to initiate operation of said first motor at a first time; and supplying electrical current to said second motor to initiate operation of said second motor at a second time wherein said first time precedes said second time by a time lapse.

19. The method of claim 18 wherein during operation of said compressor assembly, said first and second motors are each operated at a single speed.

20. The method of claim 18 wherein said first motor and said first compression mechanism and said second motor and said second compression mechanism are all mounted in a single housing.

21. The method of claim 18 wherein a time delay relay is provided in an electrical circuit coupled to said second motor to delay the supply of electrical current to said second motor.

22. The method of claim 18 comprising the further step of selecting a predetermined value of said time lapse to allow said first motor to reach a stable operating state prior to said second time.

23. The method of claim 18, wherein said time lapse is approximately between 2 seconds and 5 seconds.

* * * * *

UNITED STATES PATENT AND TRADEMARK OFFICE

CERTIFICATE OF CORRECTION

PATENT NO. : 7,028,491 B2
APPLICATION NO. : 10/812213
DATED : April 18, 2006
INVENTOR(S) : W. Travis Horton It is certified that error appears in the above-identified patent and that said Letters Patent is hereby corrected as shown below:

Claim 18, Column 9, line 34, after "mechanism" insert --,--

Claim 18, Column 9, Line 34, after "said" delete ","

Signed and Sealed this

Twenty-first Day of November, 2006

JON W. DUDAS
*Director of the United States Patent and Trademark Office*